US008267010B2

(12) United States Patent
Heppner et al.

(10) Patent No.: US 8,267,010 B2
(45) Date of Patent: Sep. 18, 2012

(54) SELF-CONTAINED COMPACTOR APPARATUS WITH PROTECTIVE COATING

(75) Inventors: Marvin Heppner, Merced, CA (US); Richard Klosinski, Marlton, NJ (US)

(73) Assignee: PTR Baler and Compactor Company, Philadelphia, PA (US)

( * ) Notice: Subject to any disclaimer, the term of this patent is extended or adjusted under 35 U.S.C. 154(b) by 0 days.

(21) Appl. No.: 13/163,344

(22) Filed: Jun. 17, 2011

(65) Prior Publication Data

US 2011/0308402 A1 Dec. 22, 2011

Related U.S. Application Data

(60) Provisional application No. 61/397,844, filed on Jun. 17, 2010.

(51) Int. Cl.
*B30B 13/00* (2006.01)
*B30B 15/04* (2006.01)

(52) U.S. Cl. ..... 100/35; 100/226; 100/229 A; 100/240

(58) Field of Classification Search ..... 100/102, 100/215, 226, 229 A, 240, 245, 35
See application file for complete search history.

(56) References Cited

U.S. PATENT DOCUMENTS

| | | | | |
|---|---|---|---|---|
| 3,881,407 | A * | 5/1975 | Goar | 100/35 |
| 4,199,262 | A * | 4/1980 | Cribb et al. | 366/44 |
| 4,729,303 | A | 3/1988 | Durbin | |
| 4,756,445 | A | 7/1988 | Agee, Sr. | |
| 5,671,862 | A | 9/1997 | Cobos | |

FOREIGN PATENT DOCUMENTS

GB 2113118 A * 8/1983

* cited by examiner

*Primary Examiner* — Jimmy T Nguyen
(74) *Attorney, Agent, or Firm* — Panitch Schwarze Belisario & Nadel LLP

(57) ABSTRACT

A self-contained compactor apparatus which includes a charge chamber and a compacting chamber for compacting and storing waste contained within the chamber. The charge chamber and the compacting chamber are integrally formed as a compacting/storage container. The compacting/storage container has a top wall, a bottom wall, a sidewall extending between the top wall and the bottom wall, and a protective coating provided on at least a portion of an interior surface of the bottom wall and on at least a portion of an interior surface of the sidewall.

10 Claims, 3 Drawing Sheets

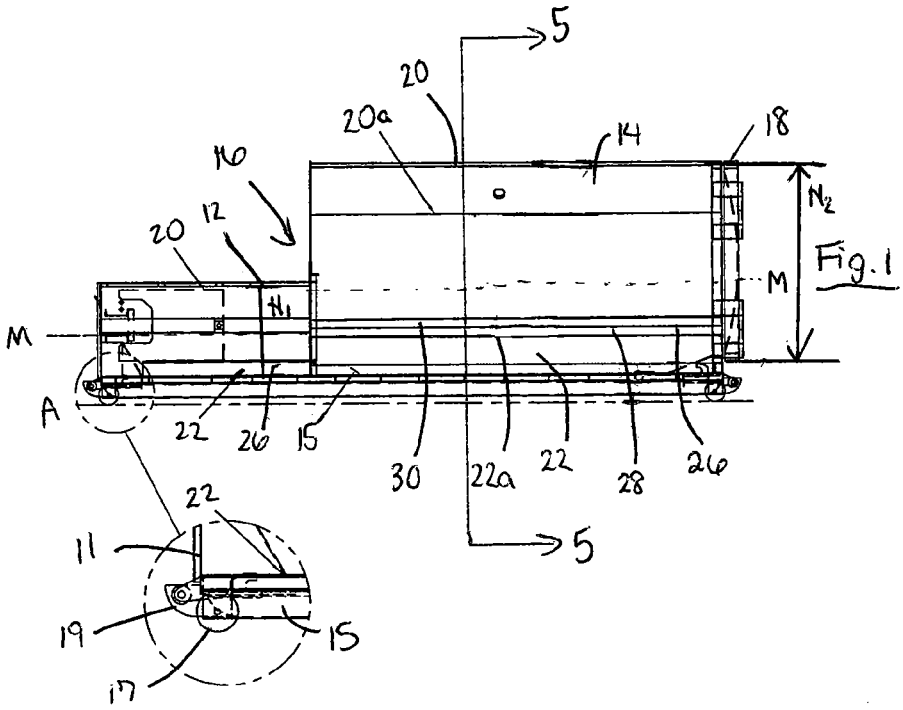
Fig. 1
Fig. 1A
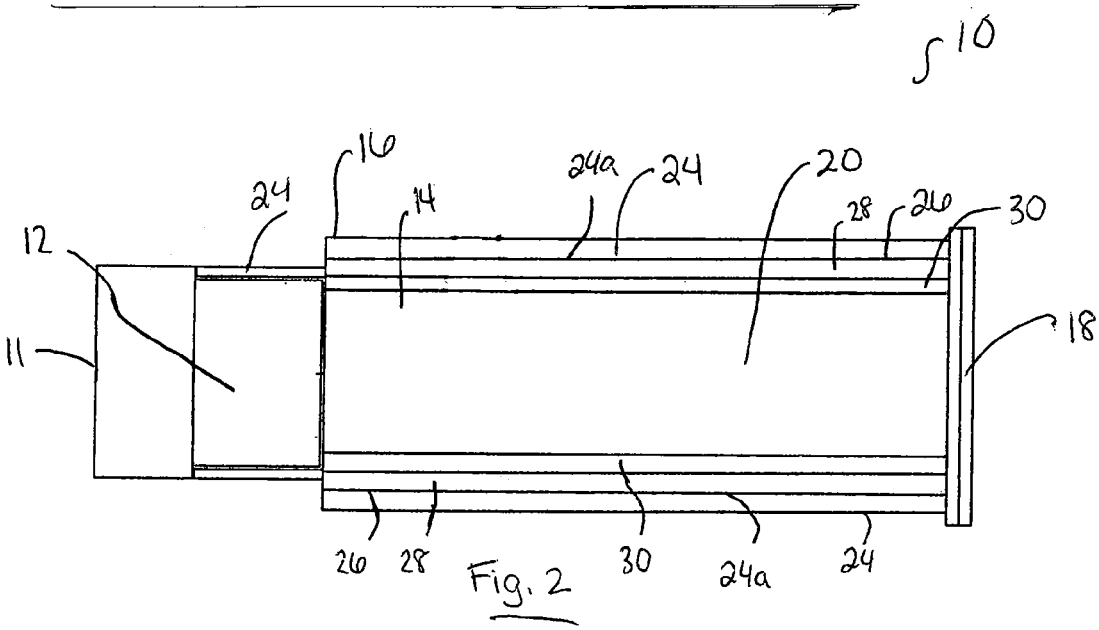
Fig. 2

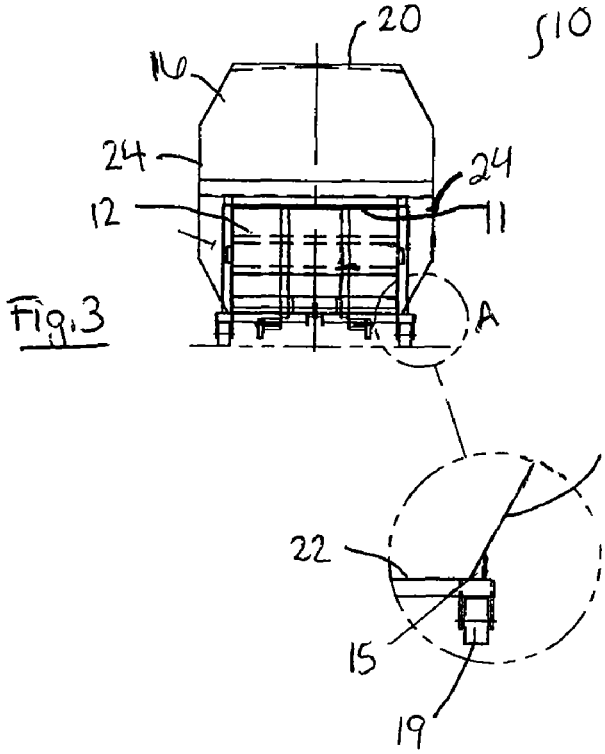
Fig. 3
Fig. 3A
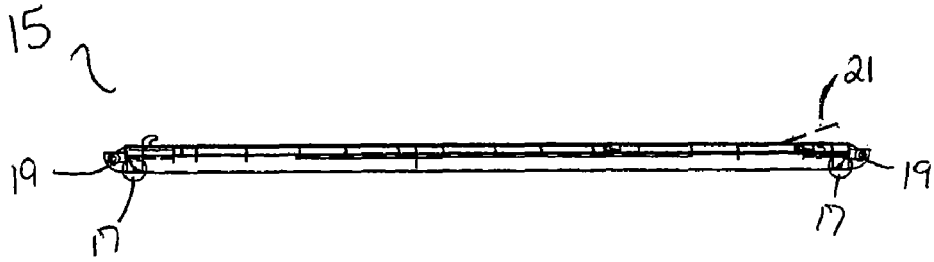
Fig. 4

SELF-CONTAINED COMPACTOR APPARATUS WITH PROTECTIVE COATING

CROSS-REFERENCE TO RELATED APPLICATIONS

This application claims the benefit of U.S. Provisional Patent Application No. 61/397,844, filed on Jun. 17, 2010 and entitled "Trash Compactor With Protective Inner Coating," the entire contents of which are incorporated by reference herein.

BACKGROUND OF THE INVENTION

Embodiments of the present invention relate generally to a compactor apparatus and, more particularly, to a self-contained commercial/industrial type waste/trash compactor apparatus which includes a protective coating on a least a portion of the interior of the apparatus for inhibiting corrosion of the compactor body and providing a barrier between the compactor body and the compactor contents.

Compactors of the type used by commercial/industrial users for compacting trash, particularly recyclable trash, such as paperboard or cardboard boxes, are generally known. Such compactors generally include a container or housing with a closable opening or door for inserting the trash to be compacted and a powered compacting device, such as a hydraulically powered ram for compressing or compacting the trash within the housing. Such compactors typically include an opening for convenient removal of the compacted trash, which can then be transported to a waste or recycling facility.

While existing compactor apparatuses are very effective, compactor apparatuses which are used in certain environments, such as movie theatres, are highly vulnerable to material failure and degradation over time, leading to the need for repair and/or replacement of the apparatus. Specifically, movie theatre waste typically contains remnants of the food and drink concessions, such as soft drinks, pop corn oils, and other residuals liquids from foods like hot dogs, hamburgers, chips and candies. These types of waste generally comprise highly acidic, abrasive and caustic materials. When a compactor apparatus is repeatedly used for compacting, such acidic and/or caustic waste, the metals which form the body and join components of the apparatus begin to corrode, break down, and require repair and/or replacement. Further, the costs of repair or replacement of the compactor apparatus body can be very high.

It is therefore desirable to provide a compactor apparatus which is adequately protected against corrosive and acidic waste. It is also desirable to provide a method for using a compactor apparatus which is adequately protected against corrosive and acidic waste, to avoid or at least diminish degradation and failure of the compactor apparatus.

BRIEF SUMMARY OF THE INVENTION

Briefly stated, an embodiment of the present invention relates to a self-contained compactor apparatus comprising a charge chamber and a compacting chamber for compacting and storing waste contained within the chamber. The charge chamber and the compacting chamber are integrally formed as a compacting/storage container. The compacting/storage container has a top wall, a bottom wall, a sidewall extending between the top wall and the bottom wall, and a protective coating provided on at least a portion of an interior surface of the bottom wall and on at least a portion of an interior surface of the sidewall.

Another embodiment of the present invention relates to a method of using a compactor apparatus. The method comprises: (a) providing a self-contained compactor apparatus proximate to a movie theatre location, the self-contained compactor apparatus comprising a charge chamber and a compacting chamber for compacting and storing waste contained within the chamber, the charge chamber and the compacting chamber being integrally formed as a compacting/storage container, the compacting/storage container having a top wall, a bottom wall, a sidewall extending between the top wall and the bottom wall, and a protective coating provided on at least a portion of an interior surface of the bottom wall and on at least a portion of an interior surface of the sidewall, at least a portion of the waste being in liquid form; (b) receiving waste from the movie theatre within an interior of the container; (c) compacting the received waste in the container; (d) storing the compacted waste in the container for a predetermined duration; and (e) transporting the container with the stored waste to a collection or disposal facility.

BRIEF DESCRIPTION OF THE SEVERAL VIEWS OF THE DRAWINGS

The following detailed description of the invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings:

FIG. 1 is side elevational view of a schematic diagram of a self-contained compactor apparatus on a supporting frame in accordance with a preferred embodiment of the present invention;

FIG. 1A is an enlarged side fragmentary view of a portion of the frame and self-contained compactor apparatus shown in FIG. 1 taken about area A in FIG. 1;

FIG. 2 is a top plan view of a schematic diagram of the self-contained compactor apparatus shown in FIG. 1;

FIG. 3 is a front elevational view of a schematic diagram of the self-contained compactor apparatus and supporting frame shown in FIG. 1;

FIG. 3A is an enlarged front fragmentary view of a portion of the frame and self-contained compactor apparatus shown in FIG. 3 taken about area A in FIG. 3;

FIG. 4 is a side elevational view of a schematic diagram of the frame that supports the self-contained compactor apparatus shown in FIG. 1;

DETAILED DESCRIPTION OF THE INVENTION

Figure 5:
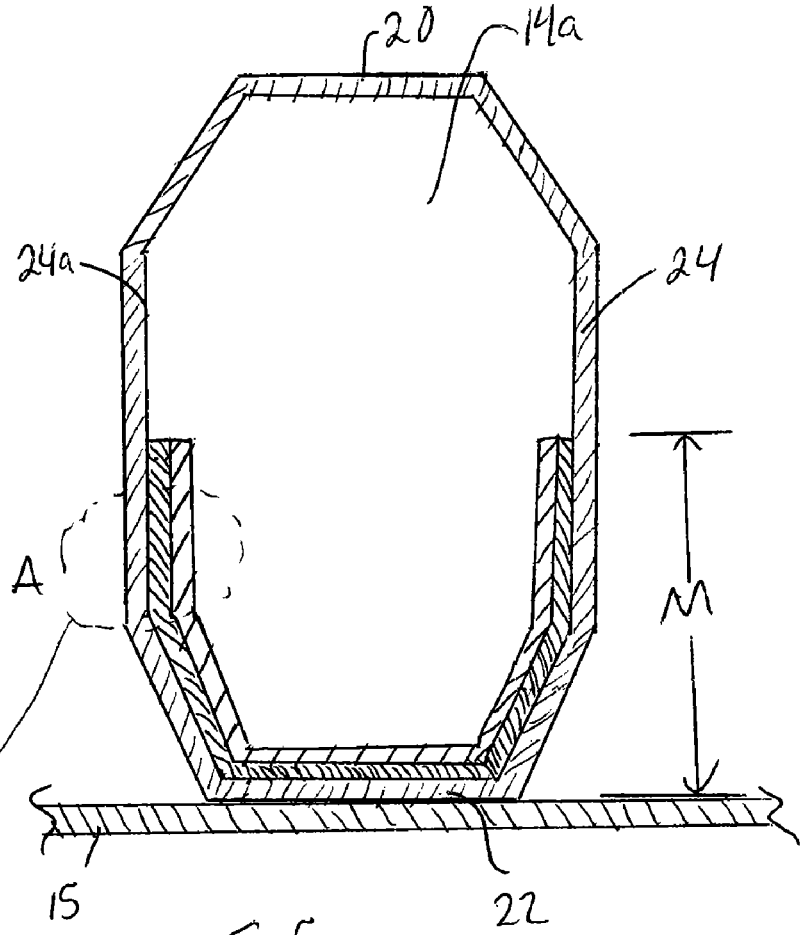
FIG. 5 is cross-sectional view of the self-contained compactor apparatus shown in FIG. 1 taken along line 5-5 of FIG. 1.
Figure 5A:
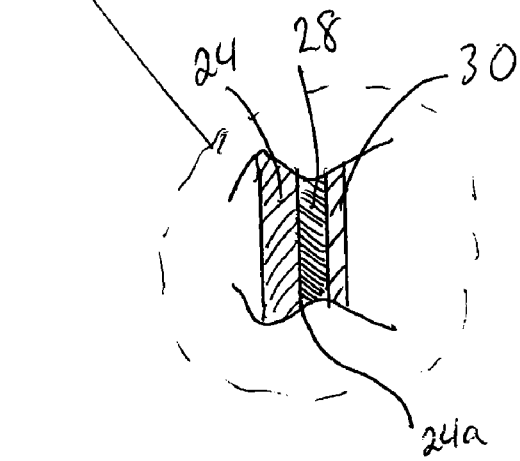
FIG. 5A is an enlarged front fragmentary view of a portion of the self-contained compactor apparatus shown in FIG. 5 taken about area A in FIG. 5.

Certain terminology is used in the following description for convenience only and is not limiting. The words "right," "left," "lower" and "upper" designate directions in the drawing to which reference is made. The words "inwardly" and "outwardly" refer to directions toward and away from, respectively, the geometric center of the apparatus and designated parts thereof. Unless specifically set forth herein, the terms "a", "an" and "the" are not limited to one element but instead should be read as meaning "at least one". The terminology includes the words noted above, derivatives thereof and words of similar import.

Referring to the drawings, wherein the same reference numerals are used to designate the same components throughout the figures, there is shown in FIGS. 1-3, a schematic diagram of a self-contained trash compactor apparatus 10 in accordance with a preferred embodiment of the present invention. Complete details of the structural and operational features of the self-contained compactor apparatus 10 are available from any of various manufacturers, such as PTR Baler and Compactor Company of Philadelphia Pa., the assignee of the present invention. Such detailed structural and operational information is not needed for a complete understanding of the present invention and will only be presented herein as needed. A brief structural description of the apparatus 10, however, if provided hereafter.

The self-contained trash compactor apparatus 10 includes a charge chamber 12 which initially receives the trash and other waste materials (not shown) to be compacted and a compacting chamber 14 in which the received trash and waste materials are compacted and stored. The charge chamber 12 and the compacting chamber 14 are integrally formed as an unitary compacting/storage container 16. In one embodiment, the frames of the charge chamber 12 and the compacting chamber 14 are securely attached to each other, such as by welding, to form the integral compacting/storage container 16. In another embodiment, the charge chamber 12 and the compacting chamber 14 are formed together, without any welding or attachment mechanisms.

In use, the self-contained compactor apparatus 10 is supported on a movable frame 15. Specifically, the frame 15 supports the compactor apparatus 10 while it is positioned at a compacting location, such as a movie theatre, and is equipped with a plurality of wheels 17 to enable easy movement of the compactor apparatus 10. Ends of the frame 15 are also provided with endcaps 19 for safety purposes.

Trash or other waste materials are fed or inserted into the charge chamber 12 through an opening 11, shown in FIG. 2. The waste materials are then pushed toward the compacting chamber 14 and are compacted therein by a hydraulically operated ram (not shown), which moves horizontally within the container 14 from the charge chamber 12 toward the compacting chamber 14. The compacted waste then remains stored within the container 16, and more specifically within the compacting chamber 14, for a predetermined duration, preferably until an interior 14*a* of the compacting chamber 14 is substantially completely filled with compacted trash and waste materials. The compacting/storage container 16 containing the compacted and stored waste is then hauled or otherwise transported to a collection and/or waste disposal facility. The compacted trash is ejected or removed from the compacting/storage container 16 via a hinged dump door 18 located at an end of the container 16 opposite from the charge door 11 and the charge chamber 12.

The compacting/storage container 16 includes a top wall 20, a bottom wall 22, and a sidewall 24 which extends between the top wall 20 and the bottom wall 22 and also around the entire peripheries of the top wall 20 and the bottom wall 22. Thus, the container 16 of the compactor apparatus 10 is completely enclosed by the top wall 20, the bottom wall 22 and the sidewall 24. At the position of the charge chamber 12, the sidewall 24 has a height H1, defined between the top wall 20 and the bottom wall 22, which is less than a height H2 of the sidewall 24 at the position of the compacting chamber 14 defined between these same two points.

Each of the walls (i.e., the top wall 20, bottom wall 22 and sidewall 24) of the compacting/storage container 16 is constructed of a metal material. Preferably, at least the interior surfaces 20*a*, 22*a* and 24*a* of the top wall 20, the bottom wall 22 and the sidewall 24, respectively, are formed of metal. More preferably, the top wall 20, the bottom wall 22 and the sidewall 24 are wholly made of a sheet steel.

To protect the metal walls of the trash compactor apparatus 10 from corrosion caused by the trash and waste materials contained therein, and more particularly the corrosion caused by the acidic and caustic fluids contained within the trash and waste materials, portions of the interior of the trash compactor apparatus 10 are preferably provided with a protective coating 26 and, more preferably, with a moisture-resistant, chemical-resistant and corrosion-resistant coating 26. Preferably, the protective coating 26 is provided on at least a portion of an interior surface 22*a* of the bottom wall 22 and on at least a portion of an interior surface 24*a* of the sidewall 24 of the trash compactor apparatus 10. Thus, the protective coating 26 is provided on portions of the interior surfaces of both the undersides of the charge chamber 12 and the compacting chamber 14.

More preferably, the protective coating 26 is provided on the entire interior surface 22*a* of the bottom wall 22. The protective coating 26 is also preferably provided on the portion of the interior surface 24*a* of the sidewall 24 which extends from at or below a midpoint M of the height H1, H2 of the sidewall 24 to the bottom wall 22. More preferably, the protective coating 26 is applied to approximately 40% of the surface area of the interior surface 24*a* of the sidewall 24 at a lower portion of the sidewall 24 (i.e., the portion below the midpoint M). However, it will be understood by those skilled in the art that the protective coating 26 may be provided on the entire surface area of the interior surfaces of the compacting/storage container 16.

In one embodiment, the protective coating is an epoxy coating 26 comprising a primer coat 28 and a top coat 30. The primer coat 28 comprises an epoxy mastic composition and the top coat 30 comprises a chemical-resistant and corrosion-resistant epoxy composition. The epoxy mastic composition of the primer coat 28 promotes adherence of the top coat 30 to the interior surfaces 22*a*, 24*a* of the bottom wall 22 and the side wall 24, respectively, of the container 16. The epoxy mastic composition is preferably a modified epoxy mastic pigmented with aluminum for improving the adhesion properties of the epoxy. However, it will be understood by those skilled in the art that the epoxy mastic may be pigmented with any metal as long as the resulting epoxy has the same or similar adhesion and elasticity properties as modified aluminum epoxy mastic. Preferably, the epoxy mastic of the primer coat 28 comprises an epoxy resin in the form of a diglycidyl ether of Bisphenol A and a polyamine curing agent. More preferably, the polyamine curing agent of the epoxy mastic is an aliphatic polyamine. A preferred example of such an epoxy mastic is the Carbomastic® 15 of Carboline®.

After application of the epoxy mastic primer composition to the interior surfaces 22*a*, 24*a* of the bottom wall 22 and the sidewall 24, respectively, the primer coat 28 is allowed to cure for a predetermined duration until a relatively hardened coating or film is formed. The curing time of the composition of the primer coat 28 varies with the surrounding temperature. For example, at a temperature of 50° F., the curing time for the epoxy mastic is five days. At a temperature of 75° F., the curing time for the epoxy mastic is twenty four hours. At a temperature of 90° F., the curing time for the epoxy mastic is eighteen hours. Preferably, the epoxy requires approximately eight hours for curing under normal drying conditions.

After the primer coat 28 has sufficiently cured, the epoxy composition of the top coat 30 is applied over the primer coat 28. The epoxy composition of the top coat 30 preferably comprises a phenol novolac epoxy resin and an amine curing agent. More preferably, the epoxy composition is primarily comprised of a phenol novolac epoxy resin, barite, benzyl alcohol, 4,4'-methylenebis (O-ethylaniline) and an amine polymer. Preferably, the epoxy composition of the top coat 30 comprises a highly cross-linked modified phenol novolac epoxy resin. Such a modified epoxy novolac coating has superior solvent resistance and high temperature resistance to acidic and caustic materials. A preferred example of such an epoxy composition is the Phenoline® 353 of Carboline®.

After application of the epoxy composition over the primer coat 28, the top coat 30 is allowed to cure for a predetermined duration until a relatively hardened coating or film is formed. Similar to the material of the primer coat 28, the curing time of the composition of the top coat 30 varies with the surrounding temperature. For example, at a temperature of 50° F., the curing time for the epoxy is a minimum of eighteen hours and a maximum of fourteen days. At a temperature of 75° F., the curing time for the epoxy is a minimum of eight hours and a maximum of seven days. At a temperature of 90° F., the curing time for the epoxy is a minimum of six hours and a maximum of two days. Preferably, the epoxy requires approximately eight hours for curing under normal drying conditions.

The cured primer coat 28 preferably has a thickness of 4 to 6 millimeters and the cured top coat preferably has a thickness of 4 to 6 millimeters. Thus, the overall thickness of the epoxy coating 26 is preferably 8 to 12 millimeters. It will be understood by those skilled in the art that multiple applications of each of the epoxy compositions may be necessary to achieve the desired thickness of each coating 28, 30. The epoxies may be applied by any conventional means. Preferably, the epoxies are applied by a roller application or a spray application. For the roller application, a phenolic core roller nap is preferably utilized. A wet mil gauge is preferably used to determine the thickness of the applied coating.

The resulting epoxy coating 26 securely protects the body of the trash compactor apparatus 10 against corrosion typically caused by the caustic waste contained therein. Preferably, the coating 26 is applied to any portions of the body of the trash compactor apparatus 10 which are contacted by fluid waste, as fluid waste tends to be the most acidic and caustic type of waste.

Preferably, prior to application of the epoxy coating 26, the portions of the interior surfaces 22*a*, 24*a* of the bottom wall 22 and sidewall 24, respectively, which are to be coated with the epoxies are pre-treated remove any contaminants, such as dirt, dust, oil or grease, which may interfere with the adhesion of the epoxy coating 26 to the interior surfaces 22*a*, 24*a*. Any conventional pre-treatment method which adequately achieves removal of harmful contaminants may be used. Examples of preferred treatment methods and applications include abrasive blasting, treatment with a solvent-based cleanser, or cleaning with an abrasive brush or other tool. A preferred example of a solvent-based cleaning solution comprises toluene.

It will be understood by those skilled in the art that the protective coating 26 need not be an epoxy-based coating. Instead, any polymeric composition which provides sufficient chemical and corrosion resistance for the metal body of the compacting/storage container 16 against acidic and caustic materials may be utilized for the coating 26 and, more particularly, for the top coat 30. For example, the protective coating 26 may comprise a polyurea-based composition and the like. Further, it will be understood by those skilled in the art that the protective coating 26 may take any appropriate form, such as a powder composition which is sprayed onto the interior surfaces and then cured, a spray-on rubber composition, and the like, as long as the metal body of the compacting/storage container 16 is sufficiently protected against acidic and caustic materials. It will also be understood by those skilled in the art that the thicknesses of the primer coat 28 and the top coat 30 will vary based on the particular composition utilized.

As an example, in another embodiment, the top coat 30 comprises a polyurea-based composition. An exemplary polyurea-based composition comprises methylene diphenyl diisocyanate (4,4' diphenylmethane diisocyanate), a urethane prepolymer and an aromatic amine. Such an exemplary polyurea-based composition is preferably applied as the top coat 30 at a thickness of approximately sixty to eighty millimeters, and typically fully cures within twenty four hours under normal operating conditions.

In a preferred embodiment, the trash compactor apparatus 10 including the coated compacting/storage container 16 is provided or disposed proximate to a movie theatre location. Waste from the movie theatre, at least a portion of which is in liquid form, is received within the interior of the compacting/storage container 16. More particularly, waste from the theatre is inserted into the charge chamber 12 and is subsequently fed to the compacting chamber 14. The received waste is then compacted within the compacting/storage container 16, and more particularly within the compacting chamber 14, by the horizontally moving hydraulic rams. The compact waste then remains stored within the compacting/storage container 16, and more particularly within the compacting chamber 14, for a predetermined duration. Preferably, to minimize costs, the compacted waste is stored within the compacting/storage container 16 until the interior of the compacting/storage container 16 is substantially completely filled with waste. Finally, the compacting/storage container 16 filled with the stored waste is transported to collection or disposal facility for disposal of the compacted waste.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims. For instance, it is understood that the present invention is not limited to use in movie theatre applications.

We claim:

1. A self-contained compactor apparatus comprising a charge chamber and a compacting chamber for compacting and storing waste contained therein, the charge chamber and the compacting chamber being integrally formed as a compacting/storage container, the compacting/storage container having a top wall, a bottom wall, a sidewall extending between the top wall and the bottom wall, and a protective coating provided on at least a portion of an interior surface of the bottom wall and on at least a portion of an interior surface of the sidewall, wherein the protective coating is an epoxy-based coating comprising (i) a primer coat including an epoxy mastic composition and (ii) a top coat including a corrosion-resistant epoxy composition.

2. The self-contained compactor apparatus of claim 1, wherein the primer coat has a thickness of 4 to 6 millimeters and the top coat has a thickness of 4 to 6 millimeters.

3. The self-contained compactor apparatus of claim 1, wherein the epoxy mastic composition comprises a diglycidyl ether of Bisphenol A and a polyamine curing agent.

4. The self-contained compactor apparatus of claim 3, wherein the curing agent is an aliphatic polyamine.

5. The self-contained compactor apparatus of claim 3, wherein the epoxy mastic composition promotes adherence of the top coat to the interior surfaces of the container.

6. The self-contained compactor apparatus of claim 1, wherein the epoxy composition of the top coat comprises a phenol novolac epoxy resin and an amine curing agent.

7. The self-contained compactor apparatus of claim 6, wherein the phenol novolac epoxy resin is a modified resin.

8. The self-contained compactor apparatus of claim 1, wherein the epoxy-based coating is provided on the entire interior surface of the bottom wall.

9. The self-contained compactor apparatus of claim 8, wherein the sidewall has a height between the top wall and the bottom wall and the epoxy-based coating is provided on a portion of the interior surface of the sidewall which extends from at or below a midpoint of the height of the sidewall to the bottom wall.

10. A method of using a compactor apparatus comprising:

(a) providing a self-contained compactor apparatus proximate to a movie theatre location, the self-contained compactor apparatus comprising a charge chamber and a compacting chamber for compacting and storing waste contained within the chamber, the charge chamber and the compacting chamber being integrally formed as a compacting/storage container, the compacting/storage container having a top wall, a bottom wall, a sidewall extending between the top wall and the bottom wall, and a protective coating provided on at least a portion of an interior surface of the bottom wall and on at least a portion of an interior surface of the sidewall, at least a portion of the waste being in liquid form, the protective coating being an epoxy-based coating comprising (i) a primer coat including an epoxy mastic composition and (ii) a top coat including a corrosion-resistant epoxy composition;

(b) receiving waste from the movie theatre within an interior of the container;

(c) compacting the received waste in the container;

(d) storing the compacted waste in the container for a predetermined duration; and (e) transporting the container with the stored waste to a collection or disposal facility.

* * * * *